US010082752B2

(12) United States Patent
Sakai et al.

(10) Patent No.: US 10,082,752 B2
(45) Date of Patent: Sep. 25, 2018

(54) FIXATION DEVICE AND IMAGE FORMATION APPARATUS

(71) Applicant: Oki Data Corporation, Tokyo (JP)

(72) Inventors: Masato Sakai, Tokyo (JP); Yoshitaka Yanai, Tokyo (JP); Takeshi Kojima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/598,827

(22) Filed: May 18, 2017

(65) Prior Publication Data

US 2017/0371282 A1 Dec. 28, 2017

(30) Foreign Application Priority Data

Jun. 27, 2016 (JP) ..... 2016-126741

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035; G03G 15/2064; G03G 15/2017; G03G 15/2042
USPC ..... 399/329
See application file for complete search history.

(56) References Cited

U.S. PATENT DOCUMENTS 5,788,808 A * 8/1998 Natarajan ..... B32B 37/0023 156/382
2005/0220507 A1* 10/2005 Uehara ..... G03G 15/2064 399/329
2015/0093165 A1* 4/2015 Kondo ..... G03G 15/206 399/329

FOREIGN PATENT DOCUMENTS

JP 2007-240623 A 9/2007

OTHER PUBLICATIONS

Translation of Matsuura (JP 2007-240623 A) listed in the IDS, publication date: Sep. 20, 2007.*

* cited by examiner

*Primary Examiner* — Walter L Lindsay, Jr.
*Assistant Examiner* — Frederick Wenderoth
(74) *Attorney, Agent, or Firm* — Metrolexis Law Group, PLLC

(57) ABSTRACT

A fixation device according to one of embodiments includes a first and second fixation units. The first fixation unit includes: a first belt; a first pad with a first elastic layer; and a first roller provided downstream of the first pad in a conveyance direction of a medium. The second fixation unit includes: a second belt; a second pad including a second elastic layer and pressed against the first pad with the first and second belts interposed in between; and a second roller provided downstream of the second pad in the conveyance direction and pressed against the first roller with the first second belts interposed in between. A thickness of at least one of the first and second elastic layers is smaller on a downstream side in the conveyance direction than on an upstream side in the conveyance direction.

18 Claims, 15 Drawing Sheets

RELATIONSHIP BETWEEN ELASTIC LAYER THICKNESS DIFFERENCE AND FIXATION RISE TIME

| RUBBER HARDNESS OF ELASTIC LAYER | NOISE |
|---|---|
| 20 DEGREES | POOR |
| 30 DEGREES | FAVORABLE |

RELATIONSHIP BETWEEN RUBBER HARDNESS AND NOISE

Fig. 13

| ELASTIC LAYER VOLUME RATIO | FIXATION UNEVENNESS | GLOSS UNEVENNESS |
|---|---|---|
| 1.1 | POOR | POOR |
| 1.2 | POOR | POOR |
| 1.3 | FAVORABLE | FAVORABLE |
| 1.4 | FAVORABLE | FAVORABLE |
| 1.5 | FAVORABLE | FAVORABLE |

RELATIONSHIP BETWEEN ELASTIC LAYER VOLUME RATIO, AND FIXATION UNEVENNESS AND GLOSS UNEVENNESS

Fig. 14

| ELASTIC LAYER TOTAL THICKNESS | FIXATION UNEVENNESS |
|---|---|
| 6.9mm | FAVORABLE |
| 7.2mm | FAVORABLE |
| 7.5mm | POOR |

RELATIONSHIP BETWEEN ELASTIC LAYER TOTAL THICKNESS AND FIXATION UNEVENNESS

FIXATION DEVICE AND IMAGE FORMATION APPARATUS

CROSS REFERENCE TO RELATED APPLICATIONS

This application claims priority based on 35 USC 119 from prior Japanese Patent Application No. 2016-126741 filed on Jun. 27, 2016, entitled "FIXATION DEVICE AND IMAGE FORMATION APPARATUS", the entire contents of which are incorporated herein by reference.

BACKGROUND

1. Field

This disclosure relates to a fixation device and an image formation apparatus, and is suitable for application to electrophotographic image formation apparatuses such as printers and copy machines, for example.

2. Description of Related Art

In an electrophotographic image formation apparatus, toner corresponding to a print image is transferred to a record medium, and the tonner is fixed on the record medium by applying heat and pressure in the fixation device. In some image formation apparatuses as described above, a nip portion including pads facing each other in the up-down direction applies pressure to a record medium in the fixation device (for example, see Japanese Patent Application Publication No. 2007-240623).

SUMMARY

However, in the above fixation devices, the pressure applied by those pads facing each other at the nip portion becomes unstable in some cases. In this case, when the toner on a record medium starts melting with the heat, the toner receives a strong pressure, and is misaligned from the target fixation position before the tonner is fixed on the record medium, which causes an image misalignment.

An object of an embodiment of the invention is to provide a fixation device and an image formation apparatus that are capable of forming better images.

A first aspect of the invention is a fixation device that includes a first fixation unit and a second fixation unit. The first fixation unit includes: a first belt; a first pad provided to face an inner circumferential surface of the first belt and including a first elastic layer; and a first roller provided to face the inner circumferential surface of the first belt downstream of the first pad in a conveyance direction of a medium. The second fixation unit includes: a second belt facing the first belt with a conveyance path of the medium interposed in between; a second pad provided to face an inner circumferential surface of the second belt, including a second elastic layer, and pressed against the first pad with the first belt and the second belt interposed in between; and a second roller provided to face the inner circumferential surface of the second belt downstream of the second pad in the conveyance direction, and pressed against the first roller with the first belt and the second belt interposed in between. The thickness of at least one of the first elastic layer and the second elastic layer is smaller on a downstream side in the conveyance direction than on an upstream side in the conveyance direction.

A second aspect of the invention is a fixation device that includes a first fixation unit and a second fixation unit. The first fixation unit includes: a first belt; a first pad provided on an inner circumferential side of the first belt and including a first elastic layer; and a first roller provided to face the inner circumferential surface of the first belt downstream of the first pad in a conveyance direction of a medium. The second fixation unit includes: a second belt facing the first belt with a conveyance path of the medium interposed in between; a second pad provided to face an inner circumferential surface of the second belt, including a second elastic layer, and pressed against the first pad with the first belt and the second belt interposed in between; and a second roller provided to face the inner circumferential surface of the second belt downstream of the second pad in the conveyance direction, and pressed against the first roller with the first belt and the second belt interposed in between. A pressure at which the first pad and the second pad are pressed against each other with the first belt and the second belt interposed in between is higher on a downstream side in the conveyance direction than on an upstream side in the conveyance direction.

A third aspect of the invention is an image formation apparatus that includes: an image formation unit configured to form an image on a medium being conveyed on a conveyance path; and first and second fixation units. The first fixation unit includes: a first belt: a first pad provided to face an inner circumferential surface of the first belt and including a first elastic layer; and a first roller provided to face the inner circumferential surface of the first belt downstream of the first pad in a conveyance direction of the medium. The second fixation unit includes: a second belt facing the first belt with the conveyance path of the medium interposed in between; a second pad provided to face an inner circumferential surface of the second belt, including a second elastic layer, and pressed against the first pad with the first belt and the second belt interposed in between; and a second roller provided to face the inner circumferential surface of the second belt downstream of the second pad in the conveyance direction, and pressed against the first roller with the first belt and the second belt interposed in between. A thickness of at least one of the first elastic layer and the second elastic layer is smaller on a downstream side in the conveyance direction than on an upstream side in the conveyance direction.

According to at least one of the above aspects, it is possible to prevent a strong nip pressure from being suddenly applied to a record medium on the upstream side in the conveyance direction of the nip portion, which contributes to forming better images.

BRIEF DESCRIPTION OF THE DRAWINGS

FIG. 13 is a table illustrating the relationship between elastic layer volume ratios, fixation unevenness, and gloss unevenness.

FIG. 14 is a table illustrating the relationship between elastic layer total thicknesses and the fixation unevenness.

DETAILED DESCRIPTION

Figure 1:
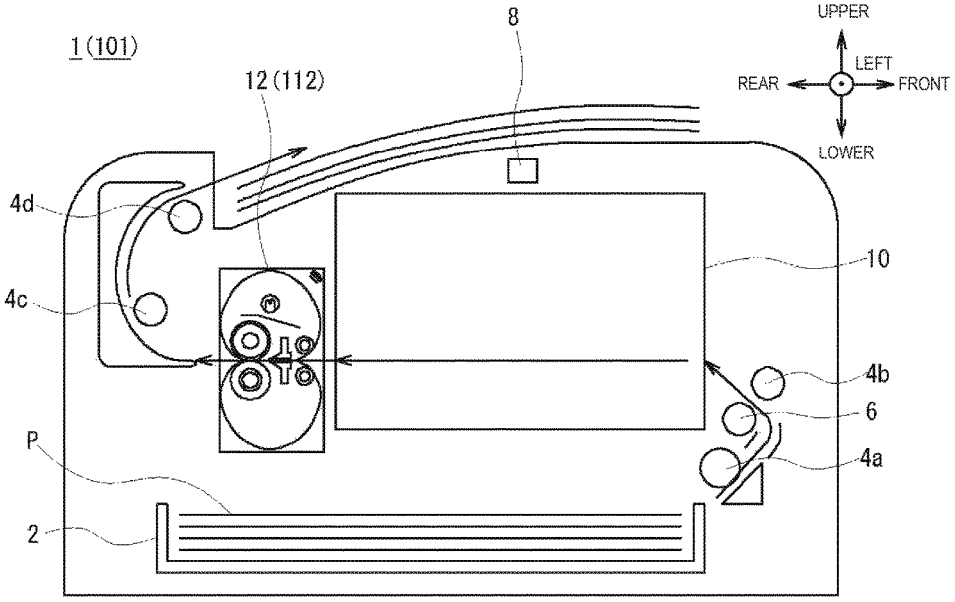
FIG. 1 is a left side view illustrating a structure of an image formation apparatus according to one or more embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. First Embodiment

[1-1. Structure of Image Formation Apparatus]

As illustrated in FIG. 1, image formation apparatus 1 is an electrophotographic printer that forms monochrome or color images, and includes paper cassette 2, conveyance rollers 4 (4*a*, 4*b*, 4*c*, and 4*d*), registration roller 6, LED (light emitting diode) head 8, toner image formation unit 10, and fixation device 12.

Paper cassette 2 holds record media P such as papers on which a toner image is to be formed. Conveyance rollers 4 are disposed in the order of conveyance rollers 4*a*, 4*b*, 4*c*, and 4*d* from the upstream side to the downstream side in the conveyance direction of record medium P and convey record medium P. Hereinafter, the right-left direction, which is orthogonal to the conveyance direction of record medium P, is also called a conveyance width direction. When an unillustrated print controller receives a print instruction, image formation apparatus 1 conveys record medium P to toner image formation unit 10 with registration roller 6 in accordance with the timing of image formation. Disposed between conveyance rollers 4*b* and 4*c* are toner image formation unit 10 and fixation device 12 located downstream of toner image formation unit 10. LED head 8 is disposed above toner image formation unit 10 and emits print light toward toner image formation unit 10. Toner image formation unit 10 transfers and forms toner image IT illustrated in FIG. 2 on record medium P as a developer image corresponding to the print light emitted from LED head 8. After fixing a toner image adhering to record medium P by applying heat and pressure, fixation device 12 discharges record medium P toward conveyance rollers 4*c* and 4*d* downstream of fixation device 12.

[1-2. Structure of Fixation Device]

Figure 2:
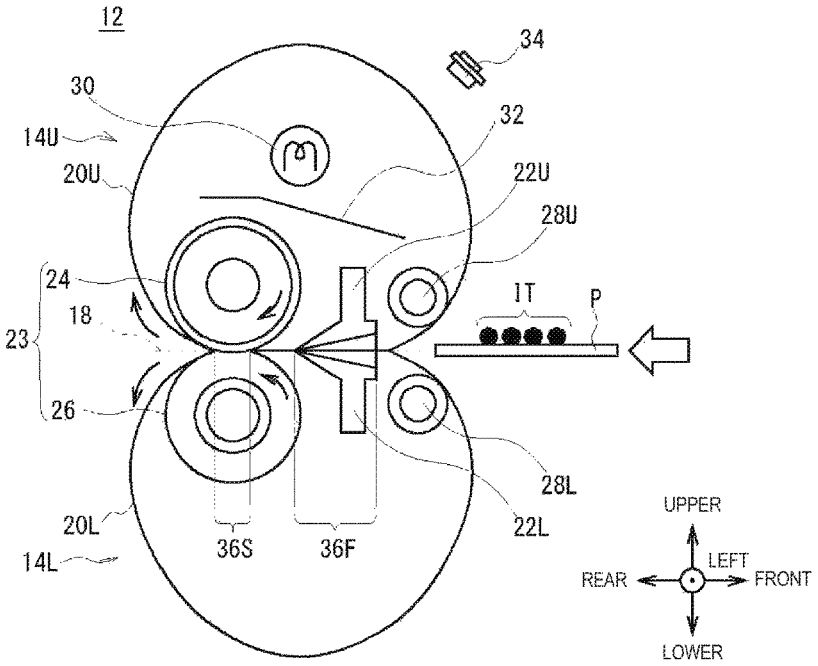
FIG. 2 is a left side view illustrating a structure of a fixation device according to a first embodiment.

As illustrated in FIG. 2, fixation device 12 includes upper fixation unit 14U, lower fixation unit 14L, and non-contact temperature sensor 34. Upper fixation unit 14U as a first fixation unit includes upper fixation belt 20U as a first belt, drive roller 24 as a first roller, upper pad 22U as a first pad, upper guide roller 28U, halogen lamp 30, and reflector 32. Lower fixation unit 14L as a second fixation unit includes lower fixation belt 20L as a second belt, pressure application roller 26 as a second roller, lower pad 22L as a second pad, and lower guide roller 28L.

Upper fixation belt 20U is arranged on the upper side of conveyance path 18 of record medium P which is along the horizontal direction, and includes, with both right and left ends thereof held, drive roller 24, upper guide roller 28U, and upper pad 22U inside. Drive roller 24 and upper guide roller 28U are rotatable with both right and left ends thereof fixed with unillustrated rotation bearings. Drive roller 24 is turned by an unillustrated drive mechanism. Both right and left ends of upper pad 22U are fixed with a support mechanism. Halogen lamp 30 as a heater member is disposed inside upper fixation belt 20U and fixed with an unillustrated support mechanism, and on/off control of halogen lamp 30 is possible at any timing by an unillustrated controller. Reflector 32 is disposed below halogen lamp 30 and covers surface layers of drive roller 24 and upper pad 22U so that these surface layers are not directly exposed to irradiation heat from halogen lamp 30. Lower fixation belt 20L is arranged on the lower side of conveyance path 18 to face to upper fixation belt 20U, and includes, with both right and left ends thereof held, pressure application roller 26, lower guide roller 28L, and lower pad 22L inside. Pressure application roller 26 and lower guide roller 28L are rotatable with both right and left ends thereof fixed with unillustrated rotation bearings. Both right and left ends of lower pad 22L is fixed with a support mechanism.

Figure 3:
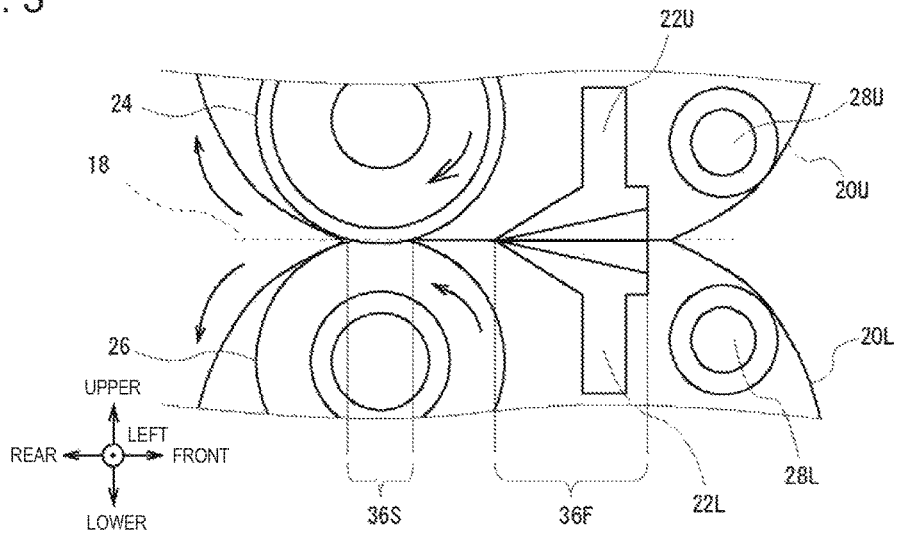
FIG. 3 is a left side view illustrating a structure of a nip portion according to the first embodiment.

Lower pad 22L and pressure application roller 26 are pressured toward upper fixation belt 20U (upward) by an unillustrated pressure application mechanism. With this pressure application, lower pad 22L is pressed against upper pad 22U with upper fixation belt 20U and lower fixation belt 20L interposed in between. This forms first nip portion 36F between upper pad 22U and lower pad 22L as illustrated in FIGS. 2 and 3 for applying pressure to record medium P. Pressure application roller 26 is pressed against drive roller 24 with upper fixation belt 20U and lower fixation belt 20L interposed in between. This forms second nip portion 36S between pressure application roller 26 and drive roller 24 as illustrated in FIGS. 2 and 3 for applying pressure to record medium P. Second nip portion 36S is located downstream of first nip portion 36F in the conveyance direction of record medium P. Hereinafter, first nip portion 36F and second nip portion 36S are also collectively called nip portions 36. Here, upper guide roller 28U and lower guide roller 28L are not pressed against each other and disposed at positions where upper guide roller 28U and lower guide roller 28L can convey upper fixation belt 20U and lower fixation belt 20L stably to nip portions 36. Non-contact temperature sensor 34, disposed around upper fixation belt 20U, measures surface temperature of upper fixation belt 20U and transmits the measurement results to the unillustrated controller. The controller performs on/off control of halogen lamp 30 such that the temperature of upper fixation belt 20U is equal to a target temperature.

Hereinafter, drive roller 24 and pressure application roller 26 are collectively called rollers 23, upper fixation belt 20U and lower fixation belt 20L are collectively called fixation belts 20, and upper pad 22U and lower pad 22L are collectively called pads 22.

[1-3. Structure of Upper Fixation Belt]

Figure 4A:
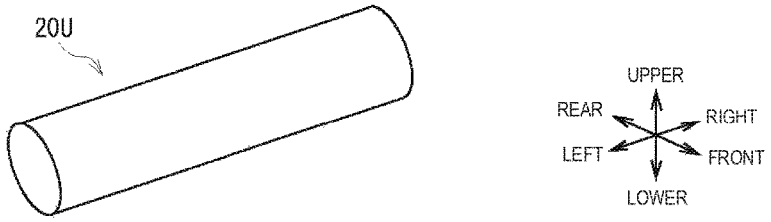
FIGS. 4A and 4B are a perspective view and a lateral cross-sectional view, respectively, illustrating a structure of an upper fixation belt.
Figure 4B:
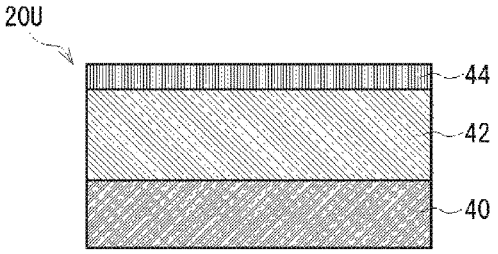

Upper fixation belt 20U and lower fixation belt 20L have almost the same structures, and hence hereinafter descriptions are provided mainly for upper fixation belt 20U. As illustrated in FIG. 4, upper fixation belt 20U includes base material 40 which is an endless belt arranged on the innermost periphery, elastic layer 42 formed on the outer circumference of the base material 40, and separation layer 44 formed on the outer circumference of elastic layer 42. Base material 40 is an endless belt made of metal having elasticity, such as stainless steel or nickel, and the thickness is preferably around 30 to 80 μm to achieve both strength and flexibility. Elastic layer 42 is a silicone rubber layer, and the thickness is preferably around 50 to 300 μm to achieve low hardness and high thermal conductivity. Separation layer 44, like elastic layer 42, is a fluorine based resin layer including a resin having high heat resistance and low surface free energy after molding, such as PFA (perfluoroalkoxy alkane), PTFE (polytetrafluoroethylene), and FEP (fluorinated ethylene propylene), and formed on elastic layer 42 by tube coating, coating, or the like. The thickness of separation layer 44 is preferably about 10 to 30 μm to achieve both high thermal conductivity and a measure against abrasion thinning.

[1-4. Structures of Upper Pad and Lower Pad]

Figure 5:
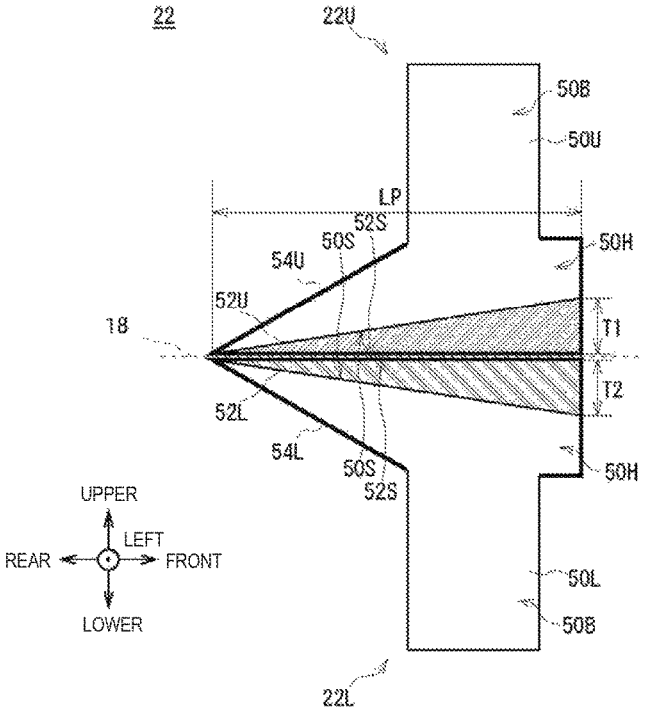
FIG. 5 is a cross-sectional view illustrating structures of an upper pad and a lower pad according to the first embodiment.

As illustrated in FIG. 5, upper pad 22U and lower pad 22L are arranged, facing to each other in the up-down direction with conveyance path 18 interposed in between. Upper pad 22U and lower pad 22L have almost the same structures, and hence hereinafter descriptions are provided mainly for upper pad 22U. Upper pad 22U includes base material 50U, elastic layer 52U which is disposed on the lower surface of base material 50U and slides over upper fixation belt 20U (FIG. 2), and slide material 54U or slippery material which covers the outer peripheral surfaces of base material 50U and elastic layer 52U. Hereinafter, when base material 50U, elastic layer 52U, and slide material 54U in upper pad 22U, and base material 50L, elastic layer 52L, and slide material 54L in lower pad 22L are not discriminated, those are expressed as base materials 50, elastic layers 52, and slide materials 54.

Base material 50 is made of a metal material such as aluminum, iron, and stainless steel, has substantially no elasticity, and maintains a certain rigidity. Base material 50 includes support portion 50B, which extends in the up-down direction and is supported by an unillustrated support mechanism not to move, and elastic layer hold portion 50H, which is formed on the conveyance path 18 side of support portion 50B and holds elastic layer 52. In addition, base material 50 has conveyance-path facing surface 50S of the base material which is linear in side view, has a planar shape, and formed on the lower surface of elastic layer hold portion 50H from the upstream end to the downstream end (from the front end to the rear end) in the conveyance direction of record medium P (FIG. 2). Conveyance-path facing surface 50S of the base material is a plane inclined with respect to conveyance path 18 such that the surface becomes gradually closer to conveyance path 18 from the upstream side toward the downstream side in the conveyance direction. Elastic layer hold portion 50H is positioned on the side of elastic layer 52 that is away from conveyance path 18 while extending from the most upstream side to the most downstream side in the conveyance direction of elastic layer 52, so that elastic layer hold portion 50H stabilizes a nip pressure described later.

Elastic layer 52 is typically made of a rubber material having high heat resistance, such as silicone rubber, sponge silicone rubber, or fluorine rubber. The end surface of elastic layer 52 that is away from conveyance path 18 has the same shape as conveyance-path facing surface 50S of the base material, and elastic layer 52 is attached to conveyance-path facing surface 50S of the base material from the upstream end to the downstream end in the conveyance direction. Note that although not illustrated, the corner of elastic layer 52 that is formed by the upstream end in the conveyance direction and the end on conveyance path 18 side is actually filleted into a curved shape. Elastic layer 52 has conveyance-path facing surface 52S of elastic layer which is formed facing conveyance path 18 from the upstream end to the downstream end in the conveyance direction, and has a planar shape along a horizontal direction parallel to conveyance path 18. Hereinafter, the length along the conveyance direction of conveyance-path facing surface 52S of elastic layer is also called pad slide length LP, and the length along the conveyance width direction of conveyance-path facing surface 52S of elastic layer is also called a pad width.

Upper pad 22U and lower pad 22L have the same pad slide lengths LP, and elastic layer thickness T1 which is the thickness of elastic layer 52U (rubber thickness) of upper pad 22U at the upstream end in the conveyance direction and elastic layer thickness T2 which is the thickness of elastic layer 52L (rubber thickness) of lower pad 22L at the upstream end in the conveyance direction are equal to each other. Specifically, in this embodiment, pad slide length LP is 12 mm, the pad width is 170 mm, and elastic layer thicknesses T1 and T2 are 3.0 mm.

Here, since conveyance-path facing surface 50S of the base material is an inclined surface that becomes gradually closer to conveyance path 18 from the upstream side toward the downstream side in the conveyance direction, accordingly, the length of elastic layer 52 in the thickness direction which is the direction orthogonal to the conveyance direction of record medium P and the conveyance width direction and the direction away from or toward conveyance path 18 (that is, the up-down direction), in other words, the thickness gradually decreases from the upstream end toward the downstream end in the conveyance direction.

As described above, in upper pad 22U and lower pad 22L, elastic layer 52U and elastic layer 52L are formed such that the upstream end in the conveyance direction is thickest and the downstream end in the conveyance direction is thinnest, and become gradually thinner from the upstream end in the conveyance direction toward the downstream end in the conveyance direction.

Slide materials 54 are formed from woven fabric made of fluorine based resin fibers, such as PFA (perfluoroalkoxy alkane), PTFE (polytetrafluoroethylene), and FEP (fluorinated ethylene propylene), and reduce sliding resistance between upper pad 22U and upper fixation belt 20U and sliding resistance between lower pad 22L and lower fixation belt 20L.

[1-5. Structure of Drive Roller]

Figure 6A:
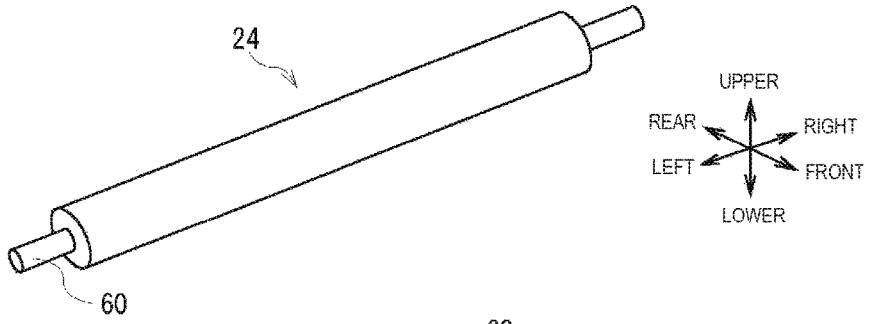
FIGS. 6A and 6B are a perspective view and a lateral cross-sectional view, respectively, illustrating a drive roller.
Figure 6B:
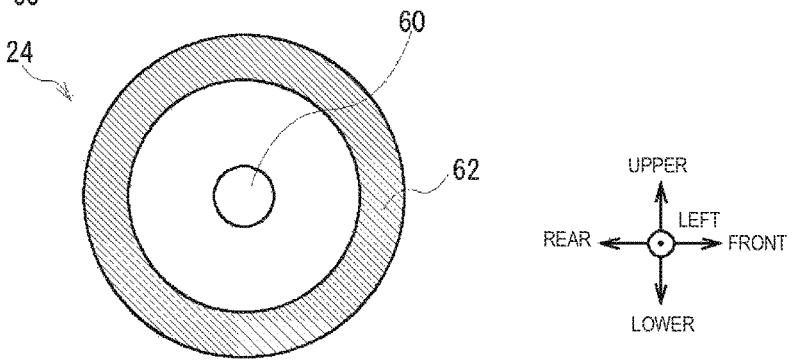

Drive roller 24 and pressure application roller 26 have almost the same structures, and hence hereinafter descriptions are provided mainly for drive roller 24. As illustrated in FIG. 6, drive roller 24 includes core metal 60 and elastic layer 62, which is formed on the outer circumferential surface of core metal 60 and covers core metal 60. For core metal 60, a pipe or shaft is used that is made of a metal, such as aluminum, iron, and stainless steel, to maintain a certain rigidity. Elastic layer 62 is typically made of a rubber material having high heat resistance, such as silicone rubber, sponge silicone rubber, or fluorine rubber. Here, core metal 60 is formed from a STKM material (a carbon steel tube for machine structural purposes in Japanese Industrial Standards). In this embodiment, the difference between drive roller 24 and pressure application roller 26 is specifications of elastic layers 62. Elastic layer 62 of drive roller 24 is made of a solid silicone rubber having a thickness of 1.25 mm and a rubber hardness of ASKER-C (Japanese Industrial Standards) 65 to 86° (specifically 70°), while elastic layer 62 of pressure application roller 26 is made of a sponge silicone rubber having a thickness of 3.25 mm and a rubber hardness of ASKER-C (Japanese Industrial Standards) 40 to 60° (specifically 40°). As above, pressure application roller 26 is formed such that the rubber hardness of elastic layer 62 thereof is lower than that of drive roller 24.

[1-6. Operation]

On receiving a print instruction from an unillustrated host apparatus, image formation apparatus 1 separates and picks up in order one of record media P stacked in paper cassette 2 and conveys record medium P to toner image formation unit 10 using conveyance rollers 4*a* and 4*b*, and registration roller 6. After transferring the toner image in an unfixed state onto record medium P with toner image formation unit 10, image formation apparatus 1 conveys record medium P to fixation device 12.

When the power of image formation apparatus 1 is off, or image formation apparatus 1 is at standby-mode in which printing is not performed, fixation device 12 is in the state where drive roller 24 and pressure application roller 26 are apart from each other and upper pad 22U and lower pad 22L are apart from each other (not illustrated). From this state, when image formation apparatus 1 starts print operation, drive roller 24 and pressure application roller 26 are pressed against each other using an unillustrated press mechanism with upper fixation belt 20U and lower fixation belt 20L interposed in between, forming second nip portion 36S, while upper pad 22U and lower pad 22L are pressed against each other with upper fixation belt 20U and lower fixation belt 20L interposed in between, forming first nip portion 36F.

After that, drive roller 24, driven by an unillustrated drive system, starts rotating in the direction indicated by the arrows in FIG. 2. Along with the rotation of drive roller 24, upper fixation belt 20U is driven by the friction force generated between upper fixation belt 20U and drive roller 24 and rotates in the same direction as drive roller 24 does. At second nip portion 36S, the moving force of upper fixation belt 20U is transferred to lower fixation belt 20L, and lower fixation belt 20L is driven to rotate in the direction indicated by the arrows at the same speed as that of upper fixation belt 20U, which conveys record medium P. The moving force of this lower fixation belt 20L is transferred to pressure application roller 26, and pressure application roller 26 is driven to rotate in the arrow direction.

Meanwhile, almost at the same time with starting driving drive roller 24, halogen lamp 30 starts generating heat, being supplied with electrical current from an unillustrated power supply circuit, and heats upper fixation belt 20U from the inside. Non-contact temperature sensor 34 detects the surface temperature of heated upper fixation belt 20U and inputs the detection results to a temperature adjustment circuit of the unillustrated controller. Based on the detected surface temperature of upper fixation belt 20U, this temperature adjustment circuit controls power supplying of the power supply circuit to halogen lamp 30 and keeps the surface temperature of upper fixation belt 20U at a target fixation temperature.

As described above, since pressure application roller 26 is formed such that the rubber hardness of elastic layer 62 thereof is lower than that of drive roller 24, elastic layer 62 (FIG. 6) of pressure application roller 26 is deformed more than elastic layer 62 of drive roller 24 at second nip portion 36S as illustrated in FIG. 3.

In addition, as described above, since the thicknesses of elastic layers 52 of upper pad 22U and lower pad 22L decrease from the upstream side toward the downstream side in the conveyance direction, the pressure of base material 50, which has almost no elasticity, at the contact points between elastic layer 52U and elastic layer 52L appears more clearly from the upstream side toward the downstream side in the conveyance direction. Hereinafter, the pressure imposed at the contact points between elastic layer 52U and elastic layer 52L is also called nip pressure. If elastic layer 52 formed from rubber material is thick, elastic layer 52 can be deformed sufficiently, and damps the nip pressure as much as elastic layer 52 is deformed. However, where elastic layer 52 is thin, elastic layer 52 can be deformed only slightly. In addition, since base material 50 exists on the side of elastic layer 52 away from conveyance path 18, and base material 50 has almost no elasticity, the nip pressure is less damped where elastic layer 52 is thinner. For this reason, at first nip portion 36F, the nip pressure decreases toward the upstream side of conveyance path 18, and increases toward the downstream side.

Figure 7A:
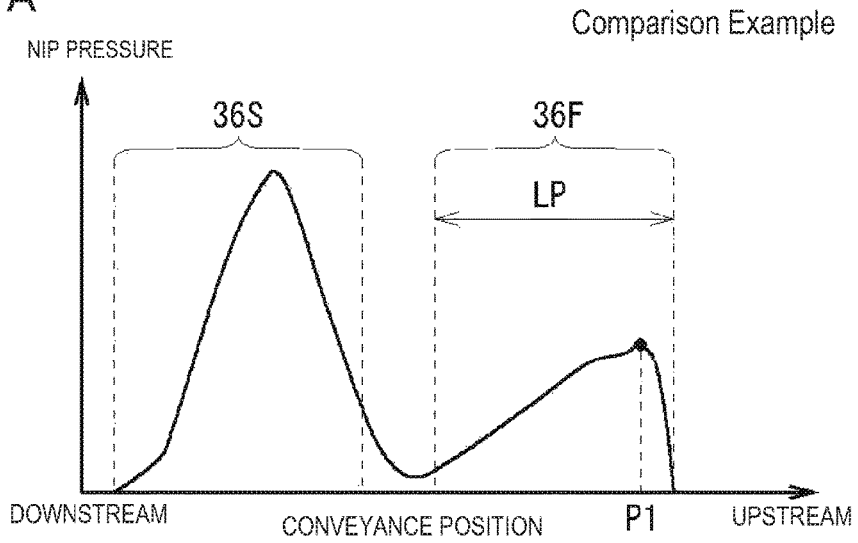
FIG. 7A is a graph illustrating a pressure distribution at a nip portion in a comparative example.
Figure 7B:
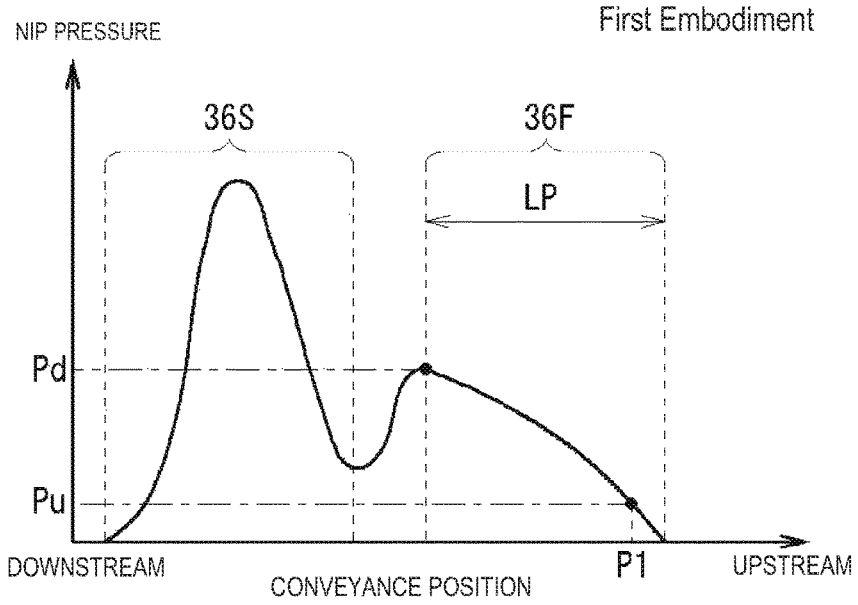
FIG. 7B is a graph illustrating a pressure distribution at the nip portion in the first embodiment.

FIG. 7B illustrates a nip portion pressure distribution that is the relationship between positions along the conveyance direction and the nip pressures at nip portions 36 of fixation device 12 in this embodiment. FIG. 7A illustrates the nip portion pressure distribution of a fixation device of a comparative example. As illustrated in FIG. 7A, in the fixation device of the comparative example, a pressure change occurs, in which a strong nip pressure is produced at the upstream side of first nip portion 36F, and after this point, the nip pressure decreases suddenly toward the downstream side. Specifically, the peak of the nip pressure is positioned at comparative-example peak position P1, which is one tenth of pad slide length LP from the upstream end toward the downstream side in the conveyance direction on the pads of the fixation device of the comparative example.

On the other hand, in this embodiment, as illustrated in FIG. 7B, first nip portion 36F demonstrates a distribution in which the nip pressure is small at the upstream end in the conveyance direction, and gradually increases almost or substantially linearly toward the downstream side. Here, upstream side nip pressure Pu of pads 22, which is the nip pressure at comparative-example peak position P1, the position one tenth of pad slide length LP from the upstream end toward the downstream side in the conveyance direction, is 200 to 500 gf/cm$^2$, and downstream side nip pressure Pd of pads 22, which is the nip pressure at the downstream end in the conveyance direction, is 1500±500 gf/cm$^2$. As described above, fixation device 12 is designed such that the nip pressure is higher at the downstream end than at the upstream end in the conveyance direction at first nip portion 36F, in other words, the peak of the nip pressure is positioned not close to the upstream end in the conveyance direction of first nip portion 36F as in a conventional fixation device, but close to the downstream end in the conveyance direction (specifically, downstream of the center between the upstream end and the downstream end in the conveyance direction of first nip portion 36F).

[1-7. Advantageous Effects and Others]

With the structure described above, image formation apparatus 1 is designed such that in fixation device 12, the thicknesses of elastic layer 52U and elastic layer 52L of upper pad 22U and lower pad 22L facing each other gradually decrease from the upstream ends in the conveyance direction toward the downstream ends in the conveyance direction. Accordingly, image formation apparatus 1 enables the nip pressure to gradually increase from the upstream ends in the conveyance direction toward the downstream ends in the conveyance direction. Thus, image formation apparatus 1 does not apply a sudden strong pressure on the upstream side in the conveyance direction to the toner image on record medium P conveyed to first nip portion 36F of fixation device 12, and can gradually apply pressure by increasing pressure as record medium P is conveyed toward the downstream side in the conveyance direction. Therefore, image formation apparatus 1 can prevent a sudden change in pressure applied to the toner image, prevent image deterioration such as image misalignment, and form excellent images.

According to the structure described above, image formation apparatus 1 includes: toner image formation unit 10 configured to form an image on record medium P conveyed through conveyance path 18; upper fixation unit 14U provided downstream of toner image formation unit 10 in the conveyance direction of record medium P and including upper fixation belt 20U, upper pad 22U provided in an interior of upper fixation belt 20U to face an inner circumferential surface of upper fixation belt 20U and including elastic layer 52U as a first elastic layer, and drive roller 24 provided in the interior of upper fixation belt 20U to face the inner circumferential surface of upper fixation belt 20U and provided at a downstream side of upper pad 22U in a conveyance direction; and lower fixation unit 14L including lower fixation belt 20L facing upper fixation belt 20U with conveyance path 18 interposed in between, lower pad 22L provided in an interior of lower fixation belt 20L to face an inner circumferential surface of lower fixation belt 20L, including elastic layer 52L as a second elastic layer, and pressed against upper pad 22U with upper fixation belt 20U and lower fixation belt 20L interposed in between, and pressure application roller 26 provided in an interior of lower fixation belt 20L to face the inner circumferential surface of lower fixation belt 20L at a downstream side of lower pad 22L in the conveyance direction, and pressed against drive roller 24 with upper fixation belt 20U and lower fixation belt 20L interposed in between, in which a thickness of at least one of elastic layer 52U and elastic layer 52L is smaller on a downstream side in the conveyance direction than on an upstream side in the conveyance direction. This enables image formation apparatus 1 to prevent a strong nip pressure from being suddenly applied to record medium P on the upstream side of first nip portion 36F in the conveyance direction.

2. Second Embodiment [2-1. Structures of Image Formation Apparatus and Fixation Device]

Figure 8:
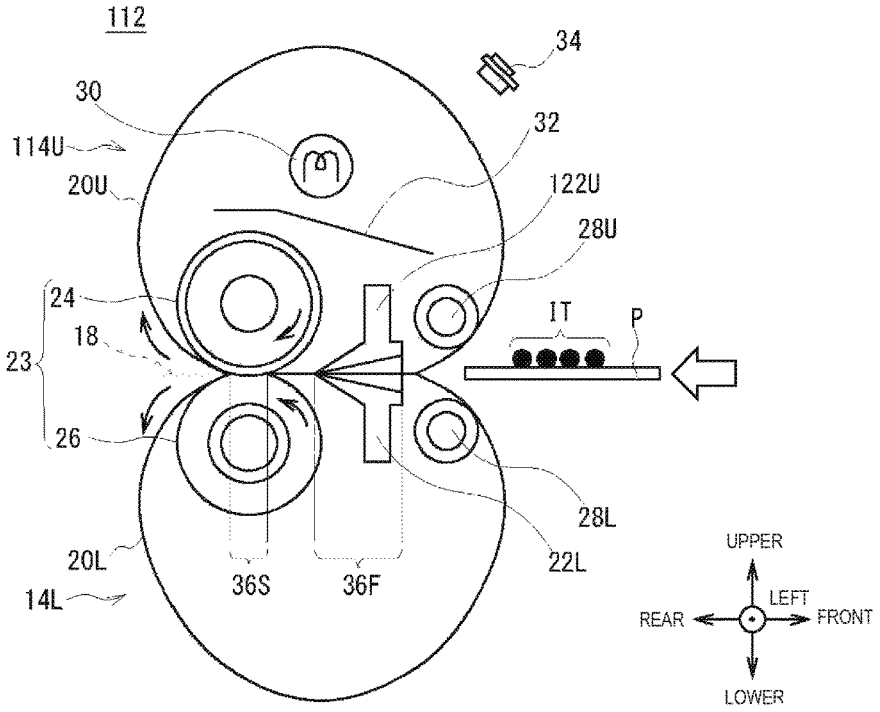
FIG. 8 is a left side view illustrating a structure of a fixation device according to a second embodiment.
Figure 9:
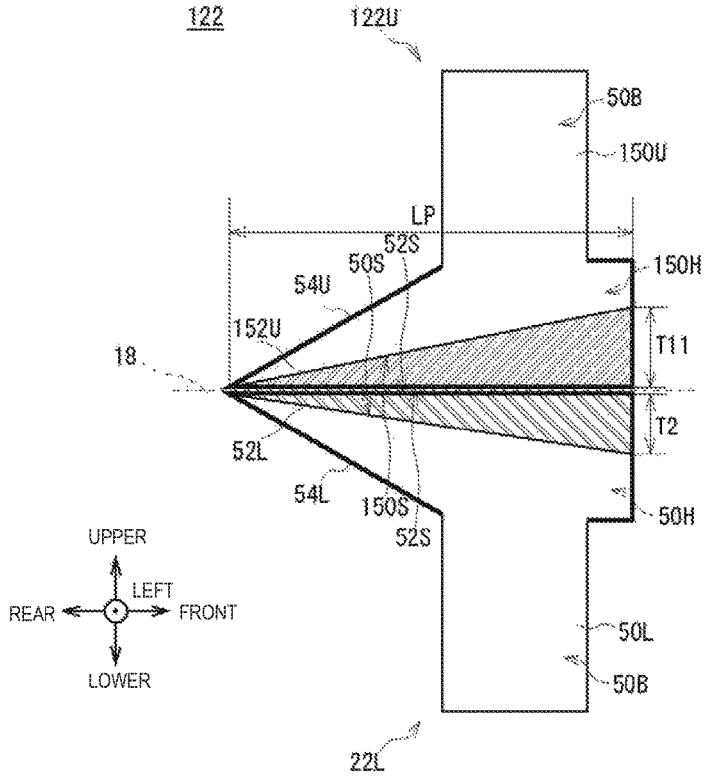
FIG. 9 is a cross-sectional view illustrating structures of an upper pad and a lower pad according to the second embodiment.

As illustrated in FIG. 1, image formation apparatus 101 according to a second embodiment, compared to image formation apparatus 1 according to the first embodiment, includes fixation device 112 instead of fixation device 12, but the other constituents are the same as those in image formation apparatus 1 according to the first embodiment. As illustrated in FIG. 8 in which the parts that are the same as those in FIG. 2 are denoted by the same reference numerals, fixation device 112, compared to fixation device 12, includes upper fixation unit 114U as a first fixation unit instead of upper fixation unit 14U, but the other constituents are the same as those in fixation device 12. As illustrated in FIG. 9 in which the parts that are the same as those in FIG. 5 are denoted by the same reference numerals, fixation device 112, compared to fixation device 12, includes pads 122 instead of pads 22.

[2-2. Structures of Upper Pad and Lower Pad]

Pads 122, compared to pads 22, include upper pad 122U of upper fixation unit 114U instead of upper pad 22U of upper fixation unit 14U, but the other constituents are the same as those in pads 22. Upper pad 122U, compared to upper pad 22U, includes base material 150U instead of base material 50U, and elastic layer 152U instead of elastic layer 52U. Base material 150U, compared to base material 50U, includes elastic layer hold portion 150H instead of elastic layer hold portion 50H. In elastic layer hold portion 150H, compared to elastic layer hold portion 50H, the angle of conveyance-path facing surface 150S of the base material with respect to the conveyance direction is larger than that of conveyance-path facing surface 50S of the base material. Elastic layer 152U is formed to be thicker than elastic layer 52U.

Pad slid lengths LP of upper pad 122U and lower pad 22L are equal to each other, while elastic layer thickness T11 which is the thickness at the upstream end in the conveyance direction of elastic layer 152U of upper pad 122U is different from elastic layer thickness T2 which is the thickness at the upstream end in the conveyance direction of elastic layer 52L of lower pad 22L. Specifically, in this embodiment, pad slide length LP is 12 mm, pad width is 170 mm, elastic layer thickness T11 is 3.9 mm, and elastic layer thickness T2 is 3.0 mm.

For upper pad 122U, the elastic layer volume which is the volume of elastic layer 152U can be obtained with the expression: pad slide length LP×elastic layer thickness T11×½×pad width, which is 12 mm×3.9 mm×½×170 mm=3978 mm$^3$. Since the silicone rubber density which is the density of silicone rubber from which elastic layer 152U is formed is 970 kg/m$^3$, the elastic layer weight which is the weight of elastic layer 152U can be obtained with the expression: silicone rubber density×elastic layer volume, which is 970 kg/m$^3$×3978 mm$^3$≈3.86 g. In addition, since the silicone rubber specific heat capacity which is the heat capacity per unit volume of silicone rubber is 1500 J/kg·K, the elastic layer heat capacity which is the heat capacity of elastic layer 152U can be obtained with the expression: elastic layer weight×silicone rubber specific heat capacity, which is 3.86 g×1500 J/kg·K=5.79 J/K.

For lower pad 22L, the elastic layer volume of elastic layer 52L can be obtained with the expression: pad slide length LP×elastic layer thickness T2×½×pad width, which is 12 mm×3.0 mm×½×170 mm=3060 $mm^3$. Since the silicone rubber density of elastic layer 52L is 970 $kg/m^3$, the elastic layer weight of elastic layer 52L can be obtained with the expression: silicone rubber density×elastic layer volume, which is 970 $kg/m^3 \times 3060\ mm^3 \approx 2.97$ g. Since the silicone rubber specific heat capacity is 1500 J/kg·K, the elastic layer heat capacity of elastic layer 52L can be obtained with the expression: elastic layer weight×silicone rubber specific heat capacity, which is 2.97 g×1500 J/kg·K=4.455 J/K.

As described above, the elastic layer volume of elastic layer 152U of upper pad 122U is 3989 $mm^3$, and the elastic layer volume of elastic layer 52L of lower pad 22L is 3060 $mm^3$. As a result, the ratio of the elastic layer volumes of elastic layer 152U to elastic layer 52L (hereinafter also called the elastic layer volume ratio) is 3978 $mm^3$/3060 $mm^3$=1.3. The sum total of elastic layer thickness T11 of elastic layer 152U and elastic layer thickness T2 of elastic layer 52L (hereinafter also called elastic layer total thickness) is 3.9 mm+3.0 mm=6.9 mm.

As described above, as for upper pad 122U and lower pad 22L, the upstream end in the conveyance direction of elastic layer 152U is formed to be thicker than the upstream end in the conveyance direction of elastic layer 52L, and the thickness of elastic layer 152U gradually decreases from the upstream end in the conveyance direction toward the downstream end in the conveyance direction in the same way as in upper pad 22U and lower pad 22L. In other words, elastic layer 152U is thicker than elastic layer 52L at any position in the conveyance direction.

In upper pad 122U and lower pad 22L, the rubber hardnesses of elastic layers 152U and 52L are set to 30 to 50 degrees, specifically 30 degrees.

[2-3. Operation and Effect]

In fixation device 12 according to the first embodiment, the area of record medium P to which pressure is applied along the conveyance direction is increased by providing upper pad 22U and lower pad 22L in addition to drive roller 24 and pressure application roller 26, compared to the case where there are only drive roller 24 and pressure application roller 26. However, on the other hand, the heat capacity of fixation device 12 itself is increased, compared to the case where upper pad 22U and lower pad 22L are not provided. In this case, as for the temperature of fixation device 12, because base materials 50U and 50L of upper pad 22U and lower pad 22L deprive heat, the fixation rise time which is the time necessary for the temperature of fixation device 12 to be stabilized is increased. Since metal material is used for base materials 50, which are apt to deprive heat from upper fixation belt 20U.

Figure 10:
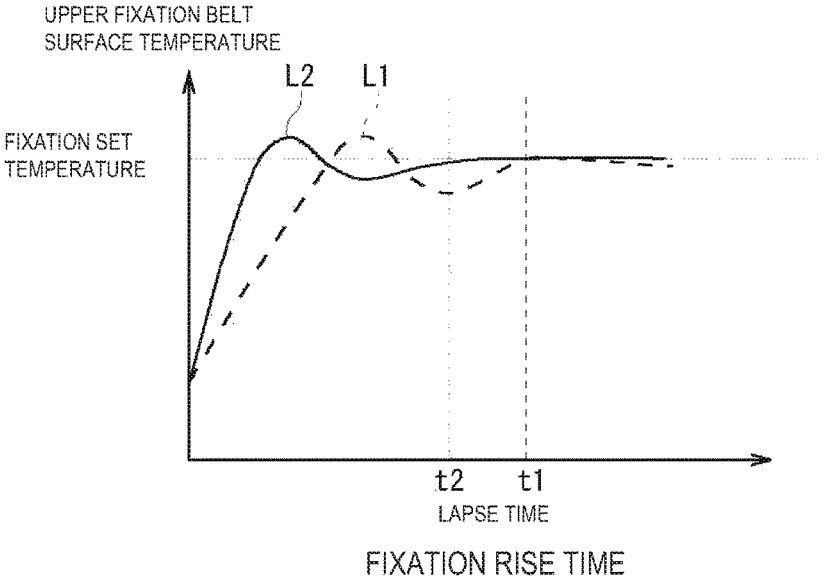
FIG. 10 is a graph illustrating fixation rise times.

FIG. 10 illustrates the rise time of fixation device 112, which is the relationship between the lapse time from the fixation operation start and the surface temperature of upper fixation belt 20U. Temperature curve L1 presented by the broken line in the graph illustrates the temperature change of upper fixation belt 20U in fixation device 12 according to the first embodiment in which elastic layer thickness T1 of upper pad 22U and elastic layer thickness T2 of lower pad 22L are the same. For temperature curve L1, temperature reaching time t1 is taken as the lapse time after the fixation operation starts and before the surface temperature of the upper fixation belt reaches a fixation set temperature and is stabilized, at which operation of applying heat and pressure to a toner image actually starts.

Temperature curve L2 presented by the solid line in the graph illustrates the temperature change of upper fixation belt 20U in fixation device 112 according to the second embodiment in which elastic layer thickness T11 of upper pad 122U is larger than elastic layer thickness T2 of lower pad 22L. Compared to temperature curve L1, temperature curve L2 reaches the fixation set temperature at temperature reaching time t2, which is an earlier time than temperature reaching time t1, and is stabilized. Thus, fixation device 112 reduces the fixation rise time compared to fixation device 12.

Figures 11, 12:
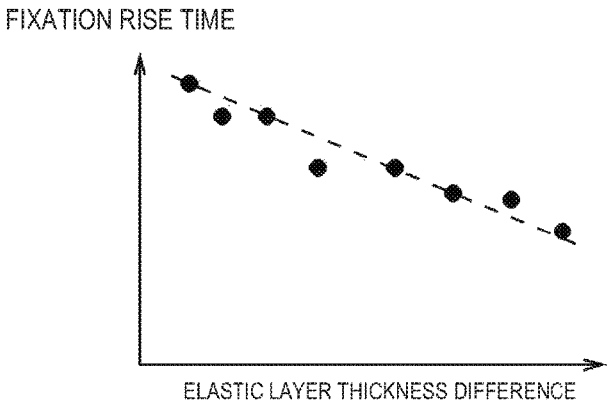
FIG. 11 is a graph illustrating the relationship between the fixation rise time and the difference between the thicknesses of elastic layers.
FIG. 12 is a table illustrating the relationship between rubber hardness and noise.

FIG. 11 is a graph illustrating the relationship between the fixation rise time and the difference between elastic layer thickness T11 of upper pad 122U and elastic layer thickness T2 of lower pad 22L (hereinafter also called elastic layer thickness difference ΔT). It can be seen that as elastic layer thickness difference ΔT increases, the fixation rise time is reduced.

As above, fixation device 112 is designed such that elastic layer 152U of upper pad 122U located on the side facing and contacting the surface of record medium P on which a toner image to be fixed is formed (in other words, the drive roller 24 side of conveyance path 18, on which halogen lamp 30 is arranged) is thicker than elastic layer 52L of lower pad 22L located on the side opposite to the surface of record medium P on which a toner image to be fixed is formed (in other words, the pressure application roller 26 side of conveyance path 18, on which halogen lamp 30 is not arranged).

Accordingly, fixation device 112 can reduce the amount of heat transferred from upper fixation belt 20U to base material 150U of upper pad 122U by elastic layer 152U blocking the heat, compared to fixation device 12. This makes it difficult for heat to escape from upper fixation belt 20U to base material 150U of upper pad 122U in image formation apparatus 101, which reduces the fixation rise time, which in turn means the reduction of waiting time before print start.

FIG. 12 is a table illustrating the relationship between occurrence of noise and the rubber hardnesses of elastic layers 152U and 52L of upper pad 122U and lower pad 22L. Since rubber, depending on the rubber hardness, has a property that oil comes out from the inside when heated, the oil, if accumulated on the inner circumferential sides of upper fixation belt 20U and lower fixation belt 20L, makes the sliding properties worse and tends to cause torque increase. It can be seen that in this embodiment, for a rubber hardness of 20 degrees, a high torque causes noise, and for a rubber hardness of 30 degrees as in the embodiment, the torque is low and the noise level is favorable. In fixation device 112, it is possible to prevent oil from coming out from the inside of the rubber when heated, by setting the rubber hardnesses of elastic layers 152U and 52L to 30 degrees or larger. As a result, the torque is kept low and the operation life increases.

FIG. 13 is a table illustrating the relationship between the elastic layer volume ratio, and fixation unevenness and gloss unevenness. It can be seen that the fixation unevenness and the gloss unevenness are favorable when the elastic layer volume ratio is set to 1.3 or larger as in this embodiment. Here, the gloss unevenness means that the gloss difference in a fixed image is large between at the leading edge and at the trailing edge in the conveyance direction of record medium P. As described above, in fixation device 112, by setting the elastic layer volume of upper pad 122U 1.3 or more times the elastic layer volume of lower pad 22L, it is possible to reduce unevenness of the pressure applied to the surface of record medium P, on which a toner image is transferred, and apply a uniform pressure to the surface of record medium P. This enables image formation apparatus 101 to prevent fixation unevenness and gloss unevenness, and form excellent images.

FIG. 14 is a table illustrating the relationship between the elastic layer total thickness and the fixation unevenness. It can be seen that setting the elastic layer total thickness to 6.9 mm as in this embodiment makes the results on the fixation unevenness favorable. When the elastic layer volume ratio is set to 1.4 and if elastic layer thickness T2 of elastic layer 52L is 3.0 mm, elastic layer thickness T11 of elastic layer 152U is calculated as 4.2 mm, and as a result, the elastic layer total thickness is 4.2 mm+3.0 mm=7.2 mm. It can be seen that also in this case, the fixation unevenness is favorable.

When the elastic layer volume ratio is set to 1.5 and if elastic layer thickness T2 of elastic layer 52L is 3.0 mm, on the other hand, elastic layer thickness T11 of elastic layer 152U is calculated as 4.5 mm, and as a result, the elastic layer total thickness is 4.5 mm+3.0 mm=7.5 mm. FIG. 13 indicates that even though the elastic layer volume ratio is 1.5, the fixation unevenness is favorable. Hence, in this case, it is preferable that the elastic layer volume ratio be 1.5 and that the elastic layer total thickness be less than 7.5 mm, by making the elastic layer thicknesses of elastic layer 52L and elastic layer 152U thinner at the same rate, for example. This is because if the elastic layer total thickness is too large, there is a tendency that pressure may not be applied correctly to record medium P.

According to the structure described above, image formation apparatus 101 includes: toner image formation unit 10 configured to form an image on record medium P conveyed through conveyance path 18; upper fixation unit 114U provided downstream of toner image formation unit 10 in the conveyance direction of record medium P and including upper fixation belt 20U, upper pad 122U as a first pad provided in the interior of upper fixation belt 20U and including elastic layer 152U as a first elastic layer arranged on a to-be-fixed tonner image formation surface side of record medium P on which a toner image to be fixed is formed, and drive roller 24 provided in the interior of upper fixation belt 20U downstream of upper pad 122U in the conveyance direction; and lower fixation unit 14L including lower fixation belt 20L facing upper fixation belt 20U with conveyance path 18 interposed in between, lower pad 22L provided in the interior of lower fixation belt 20L, including elastic layer 52L arranged on an opposite surface side of record medium P from the to-be-fixed toner image formation surface, and pressed against upper pad 122U with upper fixation belt 20U and lower fixation belt 20L interposed in between, and pressure application roller 26 provided in an interior of lower fixation belt 20L downstream of lower pad 22L in the conveyance direction, facing the inner circumferential surface of lower fixation belt 20L, and pressed against drive roller 24 with upper fixation belt 20U and lower fixation belt 20L interposed in between, in which elastic layer 152U is thicker than elastic layer 52L. This enables image formation apparatus 101 to reduce the amount of heat escaping from upper fixation belt 20U to base material 150U of upper pad 122U.

3. Other Embodiments

Note that in the above embodiments, descriptions are provided for the case where the end surface of elastic layers 52 and 152 on the side away from conveyance path 18 is formed linearly in side view, and where elastic layers 52 and 152 become gradually and linearly thinner from the upstream end toward the downstream end in the conveyance direction.

Figure 15:
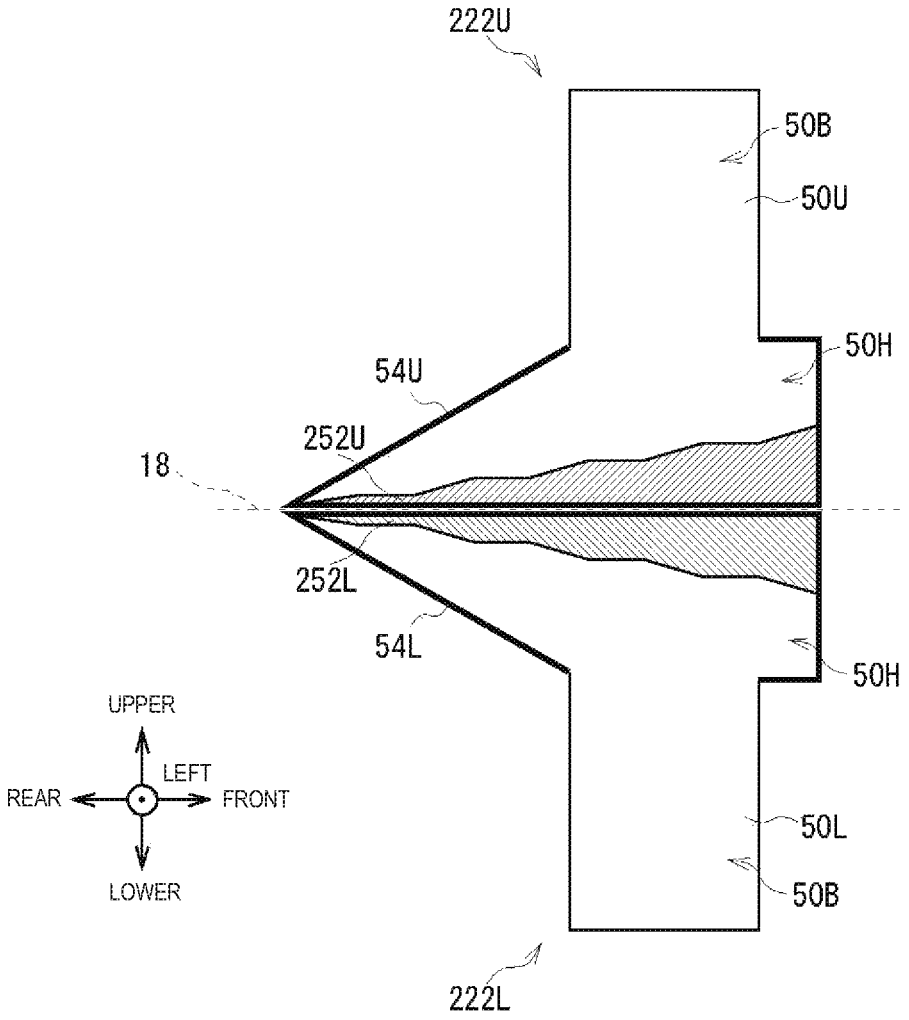
FIG. 15 is a cross-sectional view illustrating a structure (1) of an upper pad and a lower pad according to another embodiment.

The invention is not limited to this design. As in upper pad 222U and lower pad 222L illustrated in FIG. 15, the design may be made such that the end surfaces of elastic layers 252 (252U and 252L) on the sides away from the conveyance path 18 are formed in a stair-shape in side view, in other words, portions having constant thicknesses and portions having gradually decreasing thicknesses are formed alternately from the upstream end toward the downstream end in the conveyance direction, and elastic layers 252 become gradually thinner as a whole from the upstream end toward the downstream end in the conveyance direction.

Figure 16:
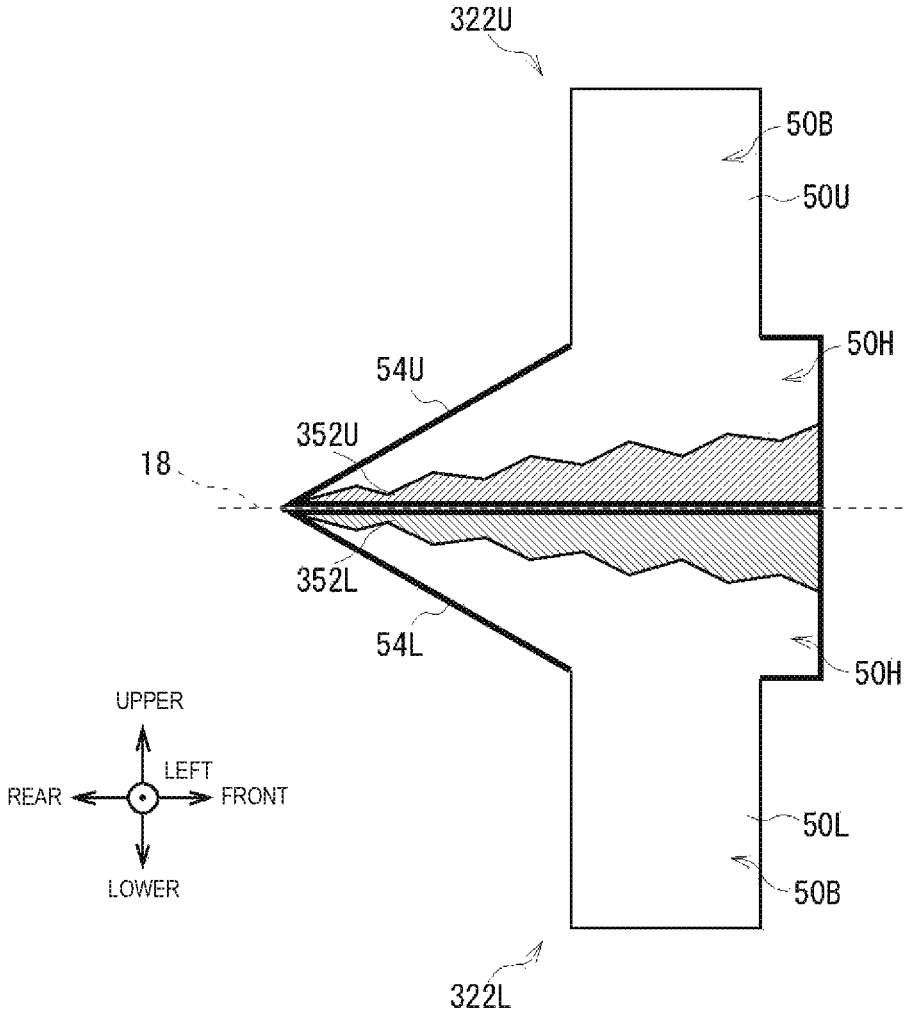
FIG. 16 is a cross-sectional view illustrating a structure (2) of an upper pad and a lower pad according to another embodiment.

Or alternatively, as in upper pad 322U and lower pad 322L illustrated in FIG. 16, the design may be made such that the end surfaces of elastic layers 352 (352U and 352L) on the sides away from the conveyance path 18 are formed in a wavy shape in side view, in other words, portions having gradually increasing thicknesses and portions having gradually decreasing thicknesses are formed alternately from the upstream end toward the downstream end in the conveyance direction, and elastic layers 352 become gradually thinner as a whole from the upstream end toward the downstream end in the conveyance direction.

Figure 17:
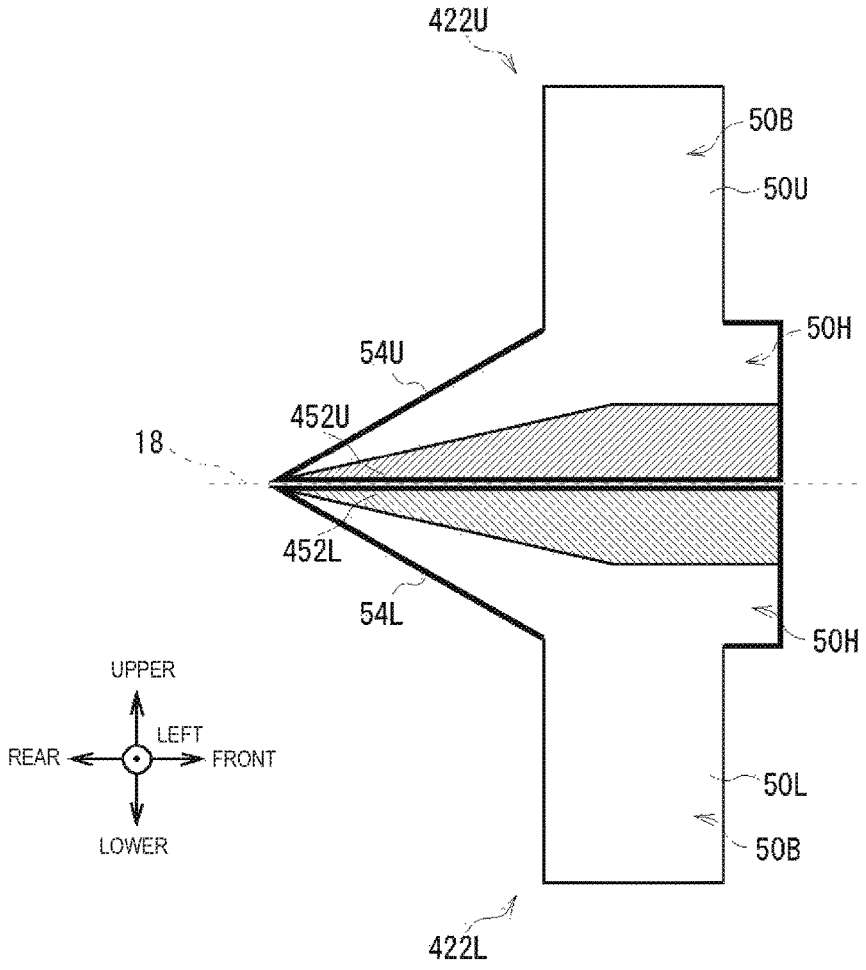
FIG. 17 is a cross-sectional view illustrating a structure (3) of an upper pad and a lower pad according to another embodiment.

Moreover, as in upper pad 422U and lower pad 422L illustrated in FIG. 17, the design may be made such that the end surfaces of elastic layers 452 (452U and 452L) on the sides away from the conveyance path 18 are formed from the upstream end toward the downstream end in the conveyance direction to include a portion having a constant thickness and a portion starting from the downstream end of the preceding portion in the conveyance direction and having thickness gradually decreasing toward the downstream side, and elastic layers 452 become gradually thinner as a whole from the upstream end toward the downstream end in the conveyance direction.

Figure 18:
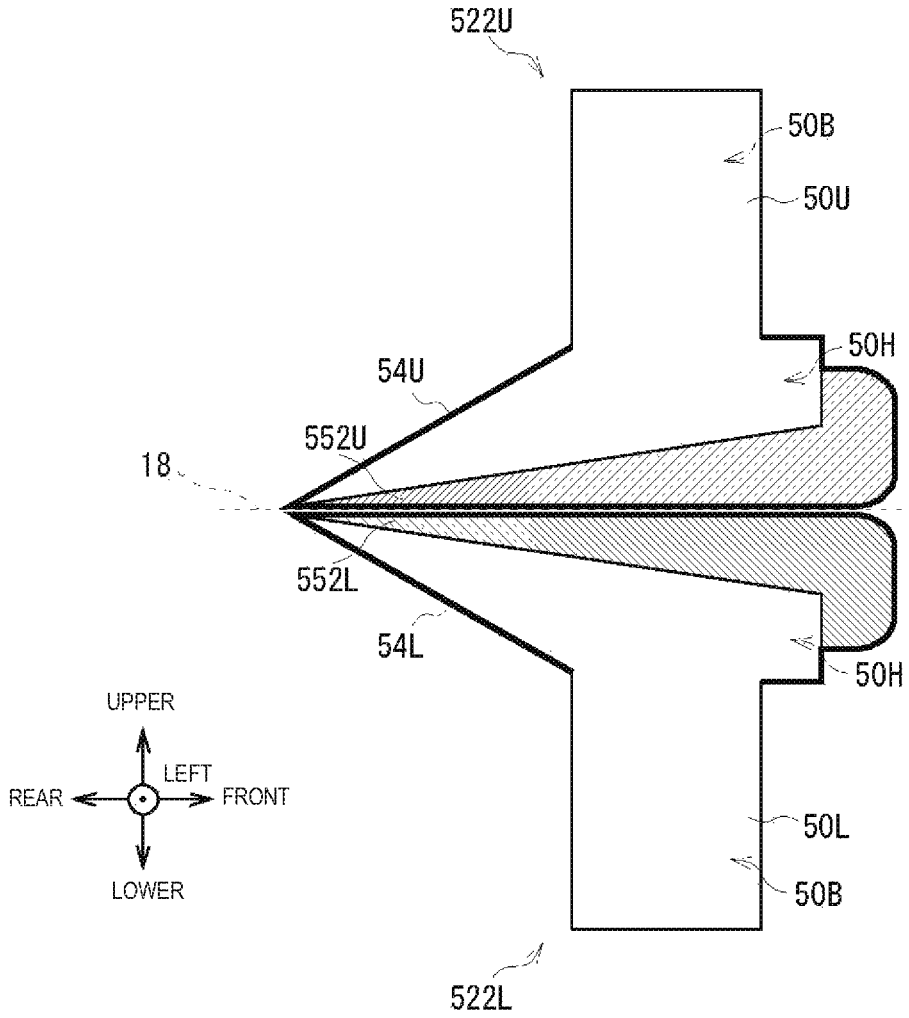
FIG. 18 is a cross-sectional view illustrating a structure (4) of an upper pad and a lower pad according to another embodiment.

Moreover, as in upper pad 522U and lower pad 522L illustrated in FIG. 18, the design may be made such that elastic layers 552 (552U and 552L) are formed to include portions extending from the upstream ends in the conveyance direction of elastic layer hold portions 50H, along the upstream end surface in the conveyance direction toward the direction away from conveyance path 18.

Furthermore, in the above first embodiment, descriptions are provided for the case where both elastic layer 52U and elastic layer 52L of upper pad 22U and lower pad 22L become gradually thinner from the upstream end in the conveyance direction toward the downstream end in the conveyance direction. The invention is not limited to this design. At least only one of elastic layer 52U and elastic layer 52L of upper pad 22U and lower pad 22L needs to become gradually thinner from the upstream end in the conveyance direction toward the downstream end in the conveyance direction. The same applies also to the second embodiment.

Figure 19:
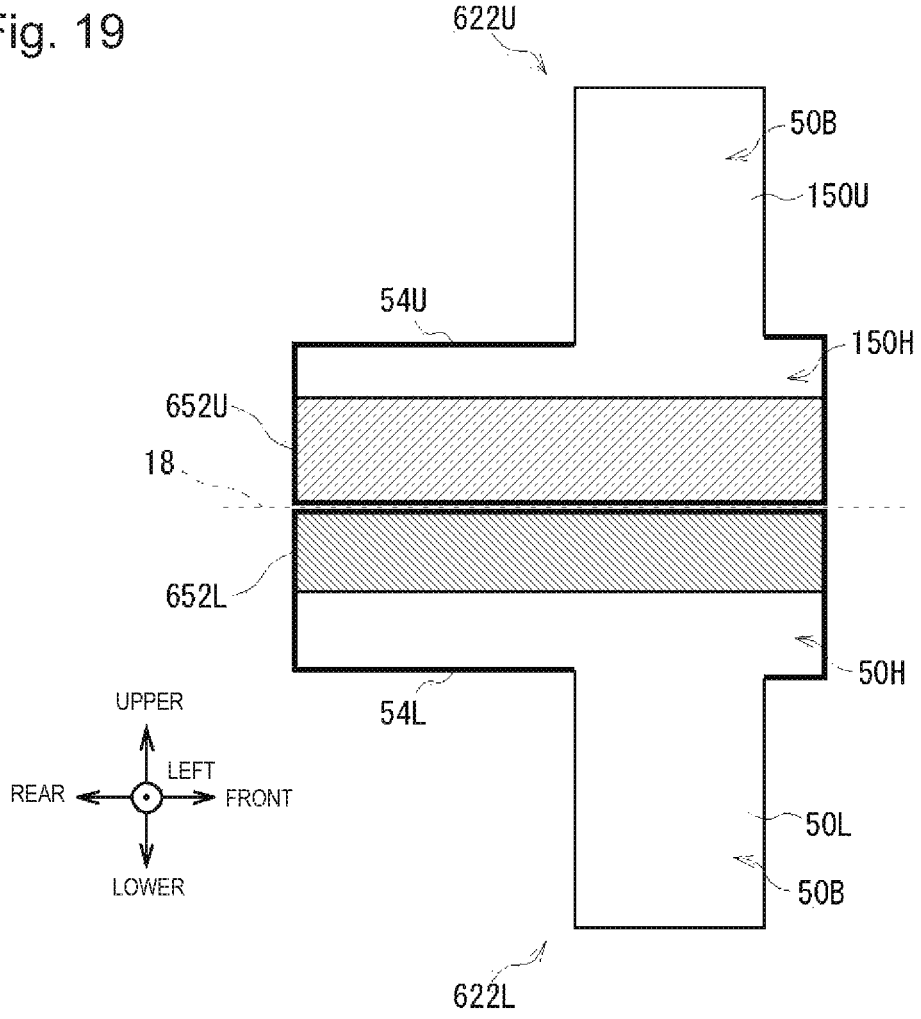
FIG. 19 is a cross-sectional view illustrating a structure (5) of an upper pad and a lower pad according to another embodiment.

In addition, in the above second embodiment, descriptions are provided for the case where the upstream end in the conveyance direction of elastic layer 152U is formed thicker than the upstream end in the conveyance direction of elastic layer 52L and the thickness of elastic layer 152U gradually decreases from the upstream end in the conveyance direction toward the downstream end side in the conveyance direction. The invention is not limited to this design. As in upper pad 622U and lower pad 622L illustrated in FIG. 19, the design may be made such that the thicknesses are constant from the upstream end in the conveyance direction to the downstream end in the conveyance direction and elastic layer 652U is formed to be thicker than elastic layer 652L.

Moreover, in the above first embodiment, descriptions are provided for the case where base material 50 includes support portion 50B and elastic layer hold portion 50H. The invention is not limited to this design. Base material 50 may include elastic layer hold portion 50H having almost no elasticity and formed in a plate shape and a member that prevents elastic layer hold portion 50H from moving away in the direction away from the conveyance path 18. The same applies also to the second embodiment.

In addition, in the above first embodiment, slide materials 54 of upper pad 22U and lower pad 22L may include lubricant impregnated therein. In that case, it is possible to further reduce the sliding resistance between upper pad 22U and upper fixation belt 20U and the sliding resistance between lower pad 22L and lower fixation belt 20L. Examples of the lubricant include silicone oil, silicone grease, and fluorine grease. Or alternatively, instead of using slide materials 54, elastic layers 52 may have a coating having physical properties of a low friction coefficient and covering the surface thereof. The same applies also to the second embodiment.

Figure 20:
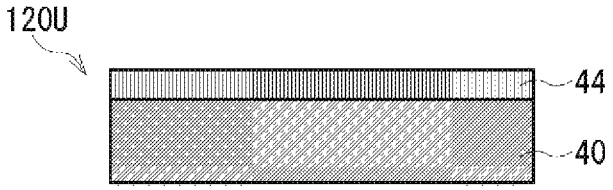
FIG. 20 is a lateral cross-sectional view illustrating the structure of an upper fixation belt according to another embodiment.

In addition, in the above embodiments, descriptions are provided for the case where upper fixation belt 20U (FIG. 4) includes base material 40, elastic layer 42, and separation layer 44. The invention is not limited to this design. As in upper fixation belt 120U illustrated FIG. 20, the upper fixation belt may have only separation layer 44 on base material 40 without elastic layer 42. The same applies also to lower fixation belt 20L.

Figure 21:
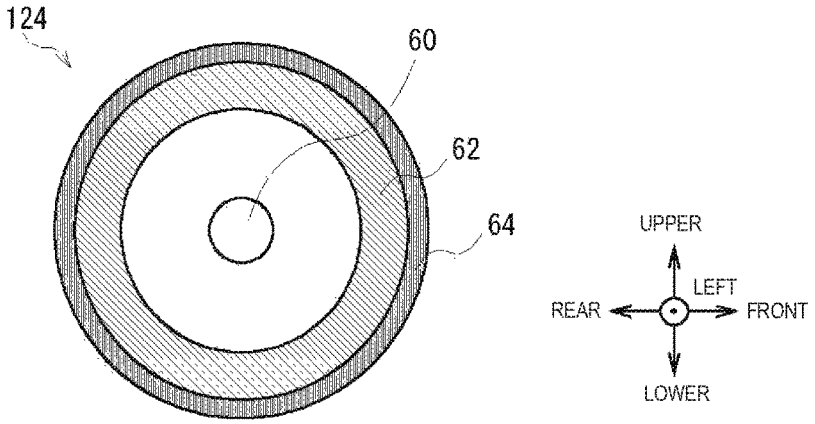
FIG. 21 is a lateral cross-sectional view illustrating the structure of a drive roller according to another embodiment.

In addition, in the above embodiments, descriptions are provided for the case where drive roller 24 (FIG. 6) includes core metal 60 and elastic layer 62. The invention is not limited to this design. As in drive roller 124 illustrated in FIG. 21, surface layer 64 may be formed on the outer circumference of elastic layer 62. Surface layer 64 is a fluorine based resin layer including a resin having high heat resistance and low surface free energy after molding, such as PFA (perfluoroalkoxy alkane), PTFE (polytetrafluoroethylene), and FEP (fluorinated ethylene propylene). In addition, surface layer 64 needs to have a certain degree of a friction coefficient on the surface in order for drive roller 124 to drive upper fixation belt 20U, lower fixation belt 20L, and pressure application roller 26.

In addition, in the second embodiment, descriptions are provided for the case where the rubber hardnesses of elastic layer 152U and elastic layer 52L are set to 30 degrees. The invention is not limited to this design. The rubber hardnesses of elastic layer 52U and elastic layer 52L according to the first embodiment may also be set to 30 degrees.

In addition, in the above embodiments, descriptions are provided for the case where halogen lamp 30 is used as a heat member. The invention is not limited to this design, and various types of heat member that generate heat may be used, such as a resistive heating element.

In addition, in the above embodiments, descriptions are provided for the case where the invention is applied to fixation device 12 in which drive roller 24 and upper pad 22U are arranged on the upper side of conveyance path 18 extending horizontally, and pressure application roller 26 and lower pad 22L are arranged on the lower side of conveyance path 18, in other words, drive roller 24 and upper pad 22U, and pressure application roller 26 and lower pad 22L are arranged so as to face each other in the up-down direction. The invention is not limited to this design, but the invention may be applied to a fixation device in which a drive roller and an upper pad, and a pressure application roller and a lower pad are arranged so as to face each other in the front-back direction.

In addition, in the above embodiments, descriptions have been provided for the case where image formation apparatus 1 as an image formation apparatus includes toner image formation unit 10 as an image formation unit, upper fixation unit 14U as a first fixation unit, and lower fixation unit 14L as a second fixation unit. However, the invention is not limited to this design, but an image formation apparatus may include an image formation unit, a first fixation unit, and a second fixation unit of other various kinds.

The invention is also utilized in image formation apparatuses such as electrophotographic printers, copy machines, and fax machines including a fixation device for fixing a toner image formed on a record medium.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A fixation device comprising:

a first fixation unit including a first belt, a first pad configured to include a first metal base material and a first elastic layer provided to on the first metal base material, and a first roller provided to face an inner circumferential surface of the first belt downstream of the first pad in a conveyance direction of a medium; and a second fixation unit including a second belt configured to face the first belt, a second pad configured to include a second metal base material and a second elastic layer provided to on the second metal base material, and pressed against the first pad with the first belt and the second belt interposed in between, and a second roller provided to face an inner circumferential surface of the second belt downstream of the second pad in the conveyance direction, and pressed against the first roller with the first belt and the second belt interposed in between, wherein the medium is conveyed between the first fixation unit and the second fixation unit, wherein a thickness of at least one of the first elastic layer and the second elastic layer is thickest on an upstream end in the conveyance direction, and is thinner on a downstream end in the conveyance direction than on the upstream end in the conveyance direction.

2. The fixation device according to claim 1, wherein one of the first elastic layer and the second elastic layer becomes thinner from the upstream side toward the downstream side in the conveyance direction.

3. The fixation device according to claim 2, wherein the one of the first elastic layer and the second elastic layer becomes gradually thinner from the upstream side toward the downstream side in the conveyance direction.

4. The fixation device according to claim 1, wherein a pressure at which the first pad and the second pad are pressed against each other with the first belt and the second belt interposed in between is higher on the upstream side in the conveyance direction than on the downstream side in the conveyance direction.

5. The fixation device according to claim 1, wherein a peak of a pressure at which the first pad and the second pad are pressed against each other with the first belt and the second belt interposed in between is positioned closer to a downstream end than to an upstream end of one of the first and second elastic layers.

6. The fixation device according to claim 1, wherein the thickness extends in a direction orthogonal to both of the conveyance direction and a conveyance width direction of the medium.

7. A fixation device comprising:

a first fixation unit including a first belt, a first pad configured to include a first metal base material and a first elastic layer provided to on the first metal base material, and a first roller provided to face an inner circumferential surface of the first belt downstream of the first pad in a conveyance direction of a medium; and a second fixation unit including a second belt configured to face the first belt, a second pad configured to include a second metal base material and a second elastic layer provided to on the second metal base material, and pressed against the first pad with the first belt and the second belt interposed in between, and a second roller provided to face an inner circumferential surface of the second belt downstream of the second pad in the conveyance direction, and pressed against the first roller with the first belt and the second belt interposed in between, wherein the medium is conveyed between the first fixation unit and the second fixation unit, wherein a thickness of at least one of the first elastic layer and the second elastic layer is thickest on an upstream end in the conveyance direction, and is thinner on a downstream end in the conveyance direction than on the upstream end in the conveyance direction, wherein a pressure at which the first pad and the second pad are pressed against each other with the first belt and the second belt interposed in between is higher on a downstream side in the conveyance direction than on an upstream side in the conveyance direction.

8. The fixation device according to claim 1, wherein the first elastic layer is provided to face a first surface of the medium, the first surface being a surface on which a developer image to be fixed is formed, the second elastic layer is provided to face a second surface of the medium opposite to the first surface, and the first elastic layer is thicker than the second elastic layer.

9. The fixation device according to claim 1, further comprising a heater member configured to generate heat inside the first fixation unit, wherein the first roller is a drive roller, and the second roller is a pressure application roller.

10. The fixation device according to claim 8, wherein a volume of the first elastic layer is at least 1.3 times a volume of the second elastic layer.

11. The fixation device according to claim 1, wherein a rubber hardness of one of the first elastic layer and the second elastic layer is at least 30 degrees.

12. An image formation apparatus comprising:

the fixation device according to claim 1; and an image formation unit configured to form an image on a medium.

13. The fixation device according to claim 1, wherein a surface of the first elastic layer and a surface of the second elastic layer are substantially parallel.

14. The fixation device according to claim 1, wherein a surface of the first elastic layer and a surface of the second elastic layer are substantially parallel to the conveyance direction of the medium.

15. The fixation device according to claim 1, wherein the first metal base material extends from the upstream end in the conveyance direction of the medium of the first elastic layer to the downstream end, the second metal base material extends from the upstream end in the conveyance direction of the medium of the second elastic layer to the downstream end.

16. The fixation device according to claim 1, wherein the first pad and the second pad are vertically symmetrical shape.

17. The fixation device according to claim 1, further comprising a heater member, and a reflector configured to cover the first pad so that the first pad is not directly exposed to irradiation heat from the heater member.

18. A fixation device comprising:

a first fixation unit including a first belt, a first pad provided to face an inner circumferential surface of the first belt and including a first elastic layer, and a first roller provided to face the inner circumferential surface of the first belt downstream of the first pad in a conveyance direction of a medium, a heater member provided inside the first belt, a reflector configured to cover the first pad so that the first pad is not directly exposed to irradiation heat from the heater member; and a second fixation unit including a second belt configured to face the first belt, a second pad provided to face an inner circumferential surface of the second belt, including a second elastic layer, and pressed against the first pad with the first belt and the second belt interposed in between, and a second roller provided to face the inner circumferential surface of the second belt downstream of the second pad in the conveyance direction, and pressed against the first roller with the first belt and the second belt interposed in between, wherein the first elastic layer is thicker than the second elastic layer.

* * * * *